US009457385B2

(12) United States Patent
Mori et al.

(10) Patent No.: US 9,457,385 B2
(45) Date of Patent: Oct. 4, 2016

(54) ULTRASONIC CLEANING METHOD AND ULTRASONIC CLEANING APPARATUS

(71) Applicant: Siltronic AG, Munich (DE)

(72) Inventors: Yoshihiro Mori, Shunan (JP); Masashi Uchibe, Izumo (JP); Teruo Haibara, Hikari (JP); Etsuko Kubo, Yokkaichi (JP)

(73) Assignee: SILTRONIC AG, Munich (DE)

( * ) Notice: Subject to any disclaimer, the term of this patent is extended or adjusted under 35 U.S.C. 154(b) by 656 days.

(21) Appl. No.: 13/892,335

(22) Filed: May 13, 2013

(65) Prior Publication Data

US 2013/0312786 A1 Nov. 28, 2013

(30) Foreign Application Priority Data

May 24, 2012 (JP) ..... 2012-118635

(51) Int. Cl.
*B08B 3/12* (2006.01)

(52) U.S. Cl.
CPC ..... *B08B 3/12* (2013.01)

(58) Field of Classification Search
CPC ..... B08B 3/12
See application file for complete search history.

(56) References Cited

U.S. PATENT DOCUMENTS

| | | | |
|---|---|---|---|
| 5,462,604 | A | 10/1995 | Shibano |
| 5,985,811 | A | 11/1999 | Masayuki et al. |
| 6,328,828 | B1 | 12/2001 | Rusczyk |
| 6,543,080 | B1 | 4/2003 | Tomita et al. |
| 2002/0177792 | A1 | 11/2002 | Ooba et al. |
| 2005/0183739 | A1 | 8/2005 | McDermott et al. |
| 2007/0215172 | A1 | 9/2007 | Watanabe et al. |
| 2009/0173358 | A1 | 7/2009 | Sinha |
| 2010/0294305 | A1 | 11/2010 | Abe et al. |
| 2011/0079253 | A1 | 4/2011 | Hasegawa et al. |

FOREIGN PATENT DOCUMENTS

| | | | |
|---|---|---|---|
| CN | 101395704 | A | 3/2009 |
| CN | 101959620 | A | 1/2011 |
| EP | 0693978 | B1 | 11/1999 |
| JP | 61015334 | A | 1/1986 |
| JP | 06296942 | A | 10/1994 |
| JP | 07303866 | A | 11/1995 |

(Continued)

OTHER PUBLICATIONS

Hodnett M, et al., High-frequency acoustic emissions generated by a 20kHz sonochemical horn processor detected using a novel broadband acoustic sensor: a preliminary study:, Ultrasonics Sonochemistry, Butterworth/Heinemann, GB, vol. 11, No. 6, Sep. 1, 2004, pp. 441-454.

(Continued)

*Primary Examiner* — Michael Kornakov
*Assistant Examiner* — Natasha Campbell
(74) *Attorney, Agent, or Firm* — Leydig, Voit & Mayer, Ltd.

(57) ABSTRACT

An ultrasonic cleaning method for cleaning an object in a liquid in which a gas is dissolved includes preparing the liquid in which the gas is dissolved. The object is cleaned while applying ultrasonic waves to the liquid so that a ratio determined by dividing a vibration strength of the liquid at a fourth-order frequency of the ultrasonic waves by a vibration strength of the liquid at a fundamental frequency of the ultrasonic waves is larger than 0.8/1000.

16 Claims, 3 Drawing Sheets

(56) References Cited

FOREIGN PATENT DOCUMENTS

| | | | |
|---|---|---|---|
| JP | 10-109072 | A | 4/1998 |
| JP | 2002345915 | A | 12/2002 |
| JP | 2003057164 | A | 2/2003 |
| JP | 2004337800 | A | 12/2004 |
| JP | 2007250726 | A | 9/2007 |
| JP | 2010153541 | A | 7/2010 |
| JP | 2011016081 | A | 1/2011 |
| JP | 2011119514 | A | 6/2011 |
| JP | 2012081430 | A | 4/2012 |
| TW | 252211 | B | 7/1995 |
| TW | 466554 | B | 12/2001 |
| TW | I 246944 | B | 1/2006 |
| TW | M 293032 | U | 7/2006 |
| TW | 200943400 | A | 10/2009 |

OTHER PUBLICATIONS

Onda Corporation: "HCT-series Cleaning Tank Hydrophane", Nov. 21, 2011, retrieved from Internet: http://www/ondacorp.com/products_HCT_Hydrophone.shtml.

"Behaviour of a Well-designed Megasonic Cleaning System", Solid State Phenomena vols. 1 03-104 (2005) pp. 155-158.

"Megasonics: A cavitation driven process", Solid State Phenomena vols. 103-104 (2005) pp. 159-162.

"High power ultrasound and acoustic cavitation—Detection", Research: Ultrasonics: Acoustics: Science + Technology: National Physical Laboratory, Mar. 25, 2010, pp. 1-3.

ULTRASONIC CLEANING METHOD AND ULTRASONIC CLEANING APPARATUS

CROSS REFERENCE TO RELATED APPLICATIONS

This application claims priority to Japanese Patent Application No. JP2012-118635, filed May. 24, 2012, which is hereby incorporated by reference herein in its entirety.

FIELD

The present invention relates to an ultrasonic cleaning method and an ultrasonic cleaning apparatus, and particularly to an ultrasonic cleaning method and an ultrasonic cleaning apparatus for cleaning an object to be cleaned in a liquid in which a gas is dissolved, by irradiating the liquid with ultrasonic waves.

BACKGROUND

In a process of manufacturing a substrate such as a silicon wafer, a substrate cleaning process of an immersion type, a single wafer type or the like has been conventionally conducted in order to remove, from the substrate, organic substances, metallic impurities, particles, natural oxide films and the like that cause a defect in a semiconductor device.

In the substrate cleaning process, various types of cleaning methods have been used depending on its purpose. Particularly when the immersion-type cleaning method is used to remove foreign substances such as particles, use is made of a method for immersing the substrate in a cleaning liquid contained in a cleaning tank and irradiating the cleaning liquid in which the substrate is immersed with ultrasonic waves having a frequency of around 1 MHz, which is called megasonic. It is generally believed that when the ultrasonic waves having a frequency of around 1 MHz are used, damage to the substrate can be reduced and the cleaning effect on submicron-size fine particles on the substrate surface can be increased.

It has been known that a concentration of a dissolved gas in the cleaning liquid affects the efficiency of removal of the foreign substances such as particles. It has been found that when ultrapure water is used as the cleaning liquid and the ultrapure water is irradiated with megasonic to remove the particles from the substrate, for example, a rate of removal of the particles from the substrate is affected by a dissolved nitrogen concentration in the cleaning liquid. More specifically, when the dissolved gas concentration in the cleaning liquid is within a prescribed range, the rate of removal of the particles from the substrate is relatively high (Japanese Patent Laying-Open Nos. JP10-109072A and JP2007-250726A). Therefore, by monitoring the dissolved gas concentration such as the dissolved nitrogen concentration in the cleaning liquid and controlling the dissolved gas concentration in the cleaning liquid to fall within a certain range in the cleaning process, it becomes theoretically possible to remove the particles effectively.

On the other hand, there is a report that the behavior of removal of the particles from the substrate is somehow related to the behavior of weak light emission (sonoluminescence) that occurs when the cleaning liquid is irradiated with the ultrasonic waves ("Behaviour of a Well Designed Megasonic Cleaning System", Solid State Phenomena Vols.103-104 (2005) pp.155-158; "Megasonics: A cavitation driven process", Solid State Phenomena Vols.103-104 (2005) pp.159-162).

SUMMARY

In an embodiment, the present invention provides an ultrasonic cleaning method for cleaning an object in a liquid in which a gas is dissolved includes preparing the liquid in which the gas is dissolved. The object is cleaned while applying ultrasonic waves to the liquid so that a ratio determined by dividing a vibration strength of the liquid at a fourth-order frequency of the ultrasonic waves by a vibration strength of the liquid at a fundamental frequency of the ultrasonic waves is larger than 0.8/1000.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
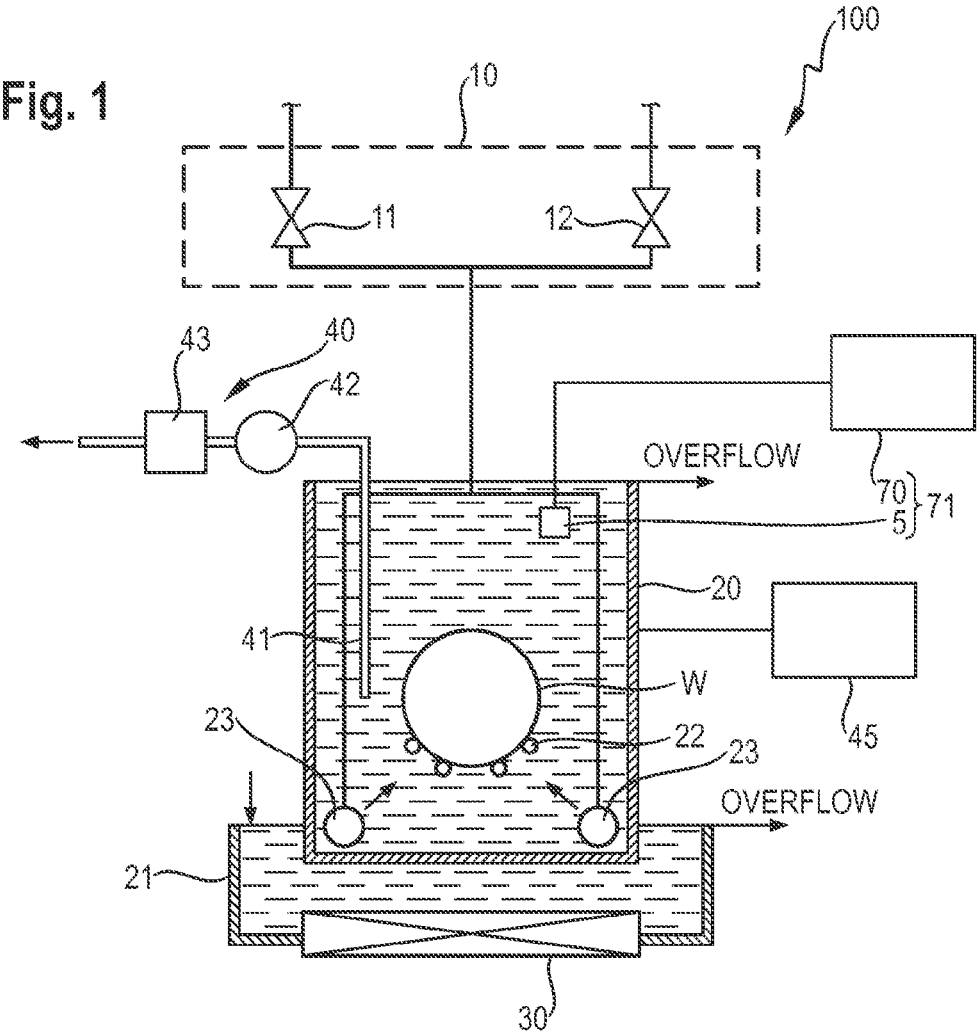
FIG. 1 is a schematic diagram showing an ultrasonic cleaning apparatus according to one embodiment of the present invention.

As a result of studies on ultrasonic cleaning of a substrate that have been conducted in the past by the inventors, it has turned out that a particle removal rate may be high or low even under the same dissolved gas concentration and the same ultrasonic irradiation conditions. Therefore, it has been difficult to realize a state having a high particle removal rate in a stable manner, simply by adjusting the dissolved gas concentration and the ultrasonic irradiation conditions.

The present invention has been made in light of the aforementioned problem, and an aspect of the present invention is to provide an ultrasonic cleaning method and an ultrasonic cleaning apparatus by which a high particle removal rate is obtained in a stable manner.

The inventors of the present invention have earnestly studied a relationship between the vibration strength of the liquid and the particle removal rate, and as a result, have obtained the following findings. Specifically, the inventors have found that the particle removal rate of the liquid can be increased by cleaning an object to be cleaned while irradiating the liquid with ultrasonic waves so that a ratio determined by dividing a vibration strength of the liquid at a fourth-order frequency of the ultrasonic waves by a vibration strength of the liquid at a fundamental frequency of the ultrasonic waves is larger than 0.8/1000. Accordingly, the inventors of the present invention have arrived at the present invention.

An ultrasonic cleaning method according to the present invention is an ultrasonic cleaning method for cleaning an object to be cleaned in a liquid in which a gas is dissolved, by irradiating the liquid with ultrasonic waves, and the method includes the following steps. The liquid in which the gas is dissolved is prepared. The object to be cleaned is cleaned while the liquid is irradiated with ultrasonic waves so that a ratio determined by dividing a vibration strength of the liquid at a fourth-order frequency of the ultrasonic waves by a vibration strength of the liquid at a fundamental frequency of the ultrasonic waves is larger than 0.8/1000. Accordingly, a high particle removal rate can be obtained in a stable manner.

Preferably, in the ultrasonic cleaning method, the step of cleaning the object to be cleaned irradiates the liquid with ultrasonic waves so that a vibration strength of the liquid at a fifth-order frequency of the ultrasonic waves is larger than the vibration strength of the liquid at the fourth-order frequency of the ultrasonic waves. Accordingly, a high particle removal rate can be obtained in a more stable manner.

Preferably, the ultrasonic cleaning method further includes the step of measuring the vibration strength of the liquid at the fourth-order frequency. The vibration strength of the liquid at the fourth-order frequency can be measured to confirm the state of the liquid.

Preferably, the ultrasonic cleaning method further includes the step of measuring the vibration strength of the liquid at the fourth-order frequency and the vibration strength of the liquid at the fundamental frequency, and the step of calculating the ratio between the vibration strength of the liquid at the fourth-order frequency and the vibration strength of the liquid at the fundamental frequency. The ratio between the vibration strength of the liquid at the fourth-order frequency and the vibration strength of the liquid at the fundamental frequency can be calculated to confirm the state of the liquid.

Preferably, regarding the ultrasonic cleaning method, in the step of cleaning the object to be cleaned, the liquid is adjusted, based on the vibration strength of the liquid at the fourth-order frequency, so that a state where bubbles containing the gas continue to be generated in the liquid is realized. Accordingly, the liquid having a high particle removal rate in a stable manner can efficiently be adjusted.

Preferably, in the ultrasonic cleaning method, the step of cleaning the object to be cleaned includes the step in which sonoluminescence occurs. Accordingly, a high particle removal rate is obtained in a more stable manner.

Preferably, in the ultrasonic cleaning method, the gas is nitrogen and a dissolved gas concentration in the liquid is 5 ppm or more.

An ultrasonic cleaning apparatus according to the present invention is an ultrasonic cleaning apparatus for cleaning an object to be cleaned in a liquid in which a gas is dissolved, by irradiating the liquid with ultrasonic waves, and the apparatus includes irradiation device, a container, and a device. The irradiation device is capable of irradiating the liquid with ultrasonic waves. The container is capable of containing the liquid. The device is capable of measuring a vibration strength of the liquid at a fourth-order frequency of the ultrasonic waves.

The ultrasonic cleaning apparatus according to the present invention has the device capable of measuring a vibration strength of the liquid at a fourth-order frequency of the ultrasonic waves. Accordingly, the state of the liquid can be confirmed.

Preferably, the ultrasonic cleaning apparatus has an adjusting mechanism capable of realizing a state where bubbles containing the gas continue to be generated in the liquid, based on the vibration strength of the liquid at the fourth-order frequency. Accordingly, the liquid having a high particle removal rate in a stable manner can efficiently be adjusted.

According to the present invention, there can be provided an ultrasonic cleaning method and an ultrasonic cleaning apparatus by which a high particle removal rate is obtained in a stable manner.

An embodiment of the present invention will be described hereinafter with reference to the drawings, in which the same reference characters are given to the same or corresponding portions and description thereof will not be repeated.

First, a configuration of an ultrasonic cleaning apparatus according to one embodiment of the present invention will be described.

As shown in FIG. 1, an ultrasonic cleaning apparatus 100 according to the present embodiment has: a cleaning tank 20 containing therein a cleaning liquid such as ultrapure water; supply 10 for supplying the cleaning liquid to this cleaning tank 20; an indirect water tank 21 storing cleaning tank 20; irradiation device 30 arranged at the bottom of indirect water tank 21, and capable of applying ultrasonic waves; monitoring device 40 for monitoring a dissolved nitrogen concentration in the cleaning liquid supplied into cleaning tank 20; and a device 71 capable of measuring the vibration strength of the liquid. Supply 10 has a first supply valve 11 for supplying ultrapure water in which nitrogen gas is dissolved to cleaning tank 20, and a second supply valve 12 for supplying degassed ultrapure water to cleaning tank 20.

First supply valve 11 is connected to a not-shown first tank. The ultrapure water in which the nitrogen gas is dissolved is stored in the first tank. Second supply valve 12 is connected to a not-shown degassed water manufacturing apparatus. Ultrapure water is supplied to the degassed water manufacturing apparatus, where a dissolved gas in the ultrapure water can be removed through a degassing membrane. The ultrapure water in which the nitrogen gas is dissolved and the degassed ultrapure water are mixed because pipes connected to first supply valve 11 and second supply valve 12 merge into one pipe on the downstream side of first supply valve 11 and second supply valve 12. A mixing tank (not shown) may be arranged on the downstream side of first supply valve 11 and second supply valve 12. In this case, the ultrapure water in which the nitrogen gas is dissolved and the degassed ultrapure water can be completely mixed in this mixing tank.

The mixed ultrapure water is then supplied to a liquid introducing pipe 23 through a pipe connected to the downstream side of aforementioned first supply valve 11 and second supply valve 12 and disposed within cleaning tank 20. Liquid introducing pipe 23 is disposed near an outer circumferential end of the bottom surface of cleaning tank 20. By adjusting the degree of opening of first supply valve 11 and second supply valve 12, the dissolved nitrogen concentration in the ultrapure water introduced into cleaning tank 20 as well as an amount of supply thereof can be controlled.

Liquid introducing pipe 23 is provided with a plurality of not-shown nozzles. Through these nozzles, the ultrapure water, which is the cleaning liquid, is supplied from liquid introducing pipe 23 into cleaning tank 20. The plurality of nozzles are spaced apart from one another along the direction in which liquid introducing pipe 23 extends. These nozzles are arranged so as to inject the cleaning liquid toward almost the central portion of cleaning tank 20 (region where a wafer W, which is an object to be cleaned, is held).

Cleaning tank 20 is a container capable of containing the cleaning liquid and a holding portion 22 for holding wafer W is disposed within cleaning tank 20. For example, wafer W can be a semiconductor wafer. With wafer W being held by holding portion 22 in cleaning tank 20, the cleaning liquid constituted by the aforementioned mixed ultrapure water is supplied from liquid introducing pipe 23 into cleaning tank 20.

As described above, liquid introducing pipe 23 is disposed at the lower part of cleaning tank 20 (near the bottom wall or in a region located at the outer circumferential portion of the bottom wall that connects the bottom wall and the sidewall). A prescribed amount of the cleaning liquid (mixed ultrapure water) is supplied from liquid introducing pipe 23 into cleaning tank 20. The amount of supply of the cleaning liquid is adjusted such that cleaning tank 20 is filled with the cleaning liquid and a prescribed amount of the cleaning liquid overflows from the upper part of cleaning tank 20. As a result, wafer W is immersed in the cleaning liquid in cleaning tank 20 as shown in FIG. 1.

A supply line (not shown) for a medium different from the medium supplied by aforementioned supply 10 is connected to indirect water tank 21. Water serving as the medium is supplied from this supply line into indirect water tank 21. At least the bottom wall of aforementioned cleaning tank 20 is in contact with the water stored in indirect water tank 21. A prescribed amount of the water continues to be supplied from the supply line to indirect water tank 21, and thereby a certain amount of the water overflows from indirect water tank 21.

Irradiation device 30 is arranged to be connected to the bottom wall of indirect water tank 21. irradiation device 30 irradiates the water in indirect water tank 21 with ultrasonic waves. The applied ultrasonic waves are applied through the water in indirect water tank 21 and a portion of cleaning tank 20 that is in contact with the water (e.g., the bottom wall) to the cleaning liquid and wafer W in cleaning tank 20.

Here, irradiation device 30 can generate ultrasonic waves having a frequency of 20 kHz or more and 2 MHz or less and a watt density of 0.05 W/cm2 or more and 7.0 W/cm2 or less, for example. Since the cleaning liquid and wafer W are irradiated with the ultrasonic waves in such a manner, wafer W immersed in the cleaning liquid can be efficiently cleaned. Ultrasonic waves having a frequency range of 400 kHz or more and 1 MHz or less are preferably used as the ultrasonic waves applied by irradiation device 30.

Monitoring device 40 includes: an extraction pipe 41 extracting a prescribed amount of the cleaning liquid from inside cleaning tank 20; a pump 42 connected to extraction pipe 41 for introducing the cleaning liquid to a dissolved nitrogen concentration meter 43; and dissolved nitrogen concentration meter 43 connected to the downstream side of pump 42. Data of the measured dissolved nitrogen concentration in the cleaning liquid is output from dissolved nitrogen concentration meter 43 to a display unit included in dissolved nitrogen concentration meter 43. A device having an arbitrary configuration can be used as dissolved nitrogen concentration meter 43. For example, a measuring device can be used, in which a dissolved gas component contained in the cleaning liquid is introduced into a receptor through a polymer film and the concentration of the gas component is calculated based on a change in thermal conductivity in this receptor.

Cleaning tank 20 is made of, for example, quartz glass having a thickness of 3.0 mm. Cleaning tank 20 can have an arbitrary shape. For example, a square water tank having a width of 270 mm, a depth of 69 mm and a height of 270 mm in terms of inside dimension is used as cleaning tank 20. A cleaning tank 20 with these dimensions has a capacity of 5 liters.

The thickness of the quartz glass plate material forming the bottom wall of cleaning tank 20 is preferably adjusted as appropriate, depending on the frequency of the ultrasonic waves emitted from irradiation device 30. For example, when the frequency of the ultrasonic waves emitted from irradiation device 30 is 950 kHz, the thickness of the plate material forming the bottom wall is preferably 3.0 mm. When the frequency of the ultrasonic waves emitted from irradiation device 30 is 750 kHz, the thickness of the plate material forming the bottom wall is preferably 4.0 mm, for example.

The amount of the cleaning liquid (mixed ultrapure water) supplied from supply 10 to cleaning tank 20 may be 5 liters/min. The frequency of the ultrasonic waves applied by irradiation device 30 may be 950 kHz and 750 kHz as described above, and the output thereof may be 1200 W (watt density of 5.6 W/cm2). A radiation surface of a vibrating plate in irradiation device 30 may have a size of 80 mm×270 mm.

A device 71 capable of measuring the vibration strength of the liquid has a hydrophone probe 5 and a measuring instrument 70. Hydrophone probe 5 is provided so that it is capable of observing the vibration strength of the liquid (namely the strength of acoustic waves in the liquid). For example, hydrophone probe 5 is a converter such as piezoelectric element, and capable of converting the strength of vibrations of the liquid due to variation of the liquid density, into an electrical signal.

Measuring instrument 70 is provided so that it is capable of measuring the electrical signal into which the strength is converted by hydrophone probe 5, and provided for measuring frequency characteristics of the vibration strength of the liquid. Measuring instrument 70 is for example a spectrum analyzer or an oscilloscope capable of performing Fast Fourier Transform. Thus, device 71 capable of measuring the vibration strength of the liquid is provided so that the frequency characteristics of the vibration strength of the liquid can be measured by the combination of hydrophone probe 5 and measuring instrument 70.

Device 71 capable of measuring the vibration strength of the liquid is provided so that it is capable of measuring the vibration strength of the liquid at a frequency (fundamental frequency) of ultrasonic waves applied from irradiation device 30 to the liquid and the vibration strength of the liquid at integral multiples of the fundamental frequency (fourth-order harmonic for example). Device 71 capable of measuring the vibration strength of the liquid is capable of measuring the vibration strength of the liquid in a frequency band of not less than 20 kHz and not more than 20 MHz for example.

Ultrasonic cleaning apparatus 100 may have a liquid adjusting mechanism 45. Liquid adjusting mechanism 45 is for example a mechanism capable of introducing a gas into the liquid. The mechanism capable of introducing a gas into the liquid has an air-bubble introducing tube (not shown) for example. The air-bubble introducing tube has one end located near the bottom surface of cleaning tank 20 and immersed in the liquid. The other end of the air-bubble introducing tube is connected for example to a gas feeder (not shown). The gas feeder is configured to be capable of feeding a gas to the liquid through the air-bubble introducing tube. The size of an opening at the one end of the air-bubble introducing tube is for example on the order of 5 mm. The gas feeder is capable of feeding a gas on the order of 1 mL to 10 mL for example.

Liquid adjusting mechanism 45 may also be a mechanism for stirring the liquid. The mechanism for stirring the liquid has for example a stirring unit (not shown). The stirring unit has a body and a blade portion. The blade portion is immersed in the liquid. One end of the body is connected for example to a drive (not shown) such as motor. The stirring unit is configured to be rotatable about the rotational axis which is the central axis of the body. Namely, the stirring unit is configured to be capable of stirring the liquid. The blade portion has a diameter on the order of 25 mm and a height on the order of 40 mm. The number of blades of the blade portion is for example six. The stirring unit is made for example of polytetrafluoroethylene (PTFE, also known under the brand name Teflon®).

Moreover, liquid adjusting mechanism 45 may further have a feedback mechanism capable of realizing a state where bubbles containing a liquid which is the dissolved gas continue to be generated in the liquid, based on the vibration strength of the liquid measured by device 71 which is capable of measuring the vibration strength of the liquid. Specifically, the feedback mechanism is a mechanism measuring, by means of device 71 capable of measuring the vibration strength of the liquid, for example, the vibration strength at a fourth-order frequency of the liquid, and stirring the liquid or introducing bubbles to the liquid, based on the value of the vibration strength.

Figure 2:
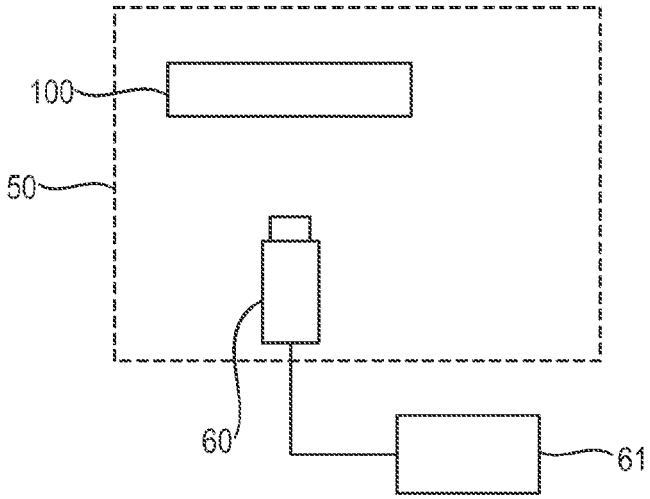
FIG. 2 shows one example of an apparatus configuration when sonoluminescence is observed.

An apparatus configuration when sonoluminescence (light emission phenomenon) is observed will be described with reference to FIG. 2. First, ultrasonic cleaning apparatus 100 and a light emission detecting apparatus 60 are disposed within a dark room 50. Light emission detecting apparatus 60 is connected to an image processing apparatus 61. An image intensifier unit (extremely weak light sensing and intensifying unit) used as light emission detecting apparatus 60 is an apparatus for sensing and intensifying extremely weak light to obtain a contrasty image. Specifically, a unit using an image intensifier (V4435U-03) manufactured by Hamamatsu Photonics K.K. can be used as this unit. In this unit, a photoelectric surface is made of Cs—Te, a sensitivity wavelength range is from 160 to 320 nm, and the highest sensitivity wavelength is 250 nm. It is believed that light emission when water is irradiated with ultrasonic waves is caused by hydroxy radical (OH radical) that occurs as a result of decomposition of the water, and the light emission has a wavelength in an ultraviolet region of around 309 nm. Therefore, the image intensifier unit having the photoelectric surface material (Cs—Te) and having the aforementioned wavelength as the sensitivity wavelength range is used. A photomultiplier may be used as light emission detecting apparatus 60. Conditions of the apparatus include, for example, an ultrasonic frequency, an ultrasonic intensity, a design of a water tank containing a solution, an amount of supply of the solution, and the like.

Next, an ultrasonic cleaning method according to the present embodiment will be described.

Figure 6:
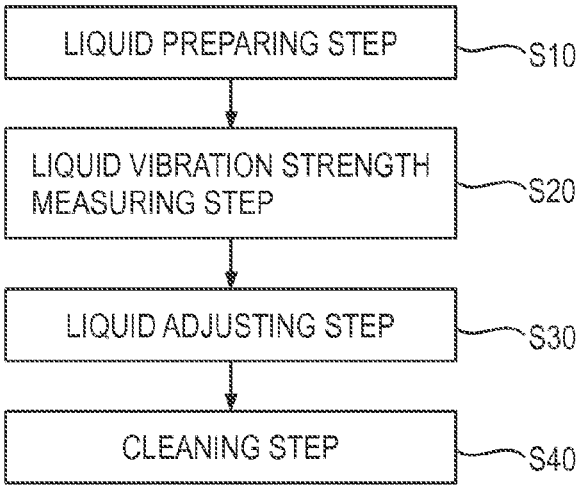
FIG. 6 is a flowchart showing an ultrasonic cleaning method according to one embodiment of the present invention.

The ultrasonic cleaning method according to the present embodiment will be described with reference to FIG. 6. The ultrasonic cleaning method according to the present embodiment is a method for cleaning wafer W (object to be cleaned) immersed in a liquid in which a gas such as nitrogen is dissolved, by irradiating the liquid with ultrasonic waves, and the method mainly includes the following steps.

First, a liquid preparing step (S10) is performed. For example, using the cleaning apparatus shown in FIG. 1, ultrapure water in which a nitrogen gas is dissolved and degassed ultrapure water are mixed, and a liquid (cleaning liquid) having a first dissolved gas concentration (C1: see FIG. 7) is prepared. The dissolved nitrogen concentration in the liquid is preferably 5 ppm or more.

Next, a liquid vibration strength measuring step (S20) is performed. Specifically, referring to FIG. 1, the vibration strength of the liquid is measured by means of hydrophone probe 5 immersed in the liquid and measuring instrument 70 for measuring a signal which is an electrical signal into which the vibration strength of the liquid measured by hydrophone probe 5 is converted.

Figure 4:
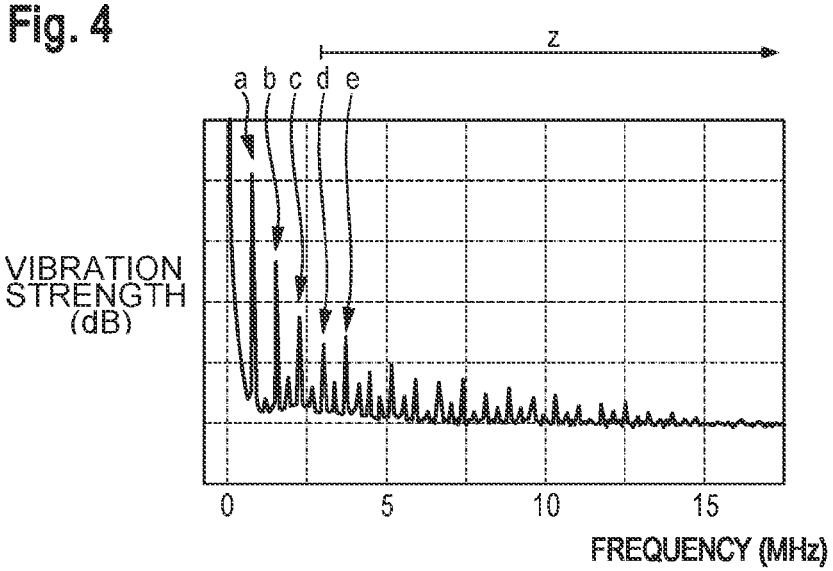
FIG. 4 shows a vibration strength spectrum when the vibration strength of a liquid is measured using an ultrasonic cleaning apparatus according to one embodiment of the present invention.

Referring to FIG. 4, an example of measurement of the vibration strength of the liquid will be described. Frequency a is the frequency (fundamental frequency) of ultrasonic waves being applied to the liquid, and is the frequency of ultrasonic waves when an object to be cleaned is cleaned. Frequency b, frequency c, frequency d, and frequency e are the second multiple, the third multiple, the fourth multiple, and the fifth multiple of the fundamental frequency, respectively. Namely, frequency b, frequency c, frequency d, and frequency e are second-order frequency, third-order frequency, fourth-order frequency, and fifth-order frequency.

With the liquid irradiated with the ultrasonic waves, the vibration strength of the liquid at the frequency (fundamental frequency) of the ultrasonic waves and the vibration strength of the liquid at the fourth multiple of the frequency (fourth-order frequency) of the ultrasonic waves are measured. Preferably, the vibration strength of the liquid is measured at the fourth or higher order frequencies (frequency region z in FIG. 4) of the ultrasonic waves.

After this, the ratio between the vibration strength of the liquid at the fourth-order frequency and the vibration strength of the liquid at the fundamental frequency is calculated. The ratio between the vibration strength of the liquid at the fifth-order frequency and the vibration strength of the liquid at the fundamental frequency may also be calculated.

Next, a liquid adjusting step (S30) is performed. Specifically, in the liquid adjusting step, a gas is introduced into the liquid while the liquid is irradiated with the ultrasonic waves. For example, the gas is introduced into the liquid from the outside using a bubble introducing tube, and thereby bubbles are generated in the liquid. Although the gas introduced into the liquid is, for example, nitrogen, the gas is not limited thereto. The gas introduced into the liquid may be, for example, argon (Ar), helium (He), air or the like. From the viewpoint of generating the bubbles in the liquid, it is desirable to use a gas having a low degree of solubility in water, which is the liquid.

The gas introduced into the liquid has a volume of, for example, 10 mL. Preferably, the gas introduced into the liquid has a volume of 1 mL or more. The pressure of the gas may be any pressure as long as it overcomes the pressure of the liquid and allows formation of the bubbles.

In the liquid adjusting step (S30), the liquid may also be stirred while the liquid is irradiated with the ultrasonic waves, for example. Preferably, the stirring unit may be driven in the liquid to cause bubbles of the gas dissolved in the liquid to be generated. Specifically, the stirring unit immersed in the liquid is rotated by a motor for example to thereby stir the liquid. The number of revolutions of the stirring unit is for example 1400 rpm (revolutions per minute). Preferably, the number of revolutions of the stirring unit is 1400 rpm or more. Stirring the liquid includes agitating the liquid. For example, the stirring unit may be moved to and fro vertically or laterally to stir the liquid.

Figure 7:
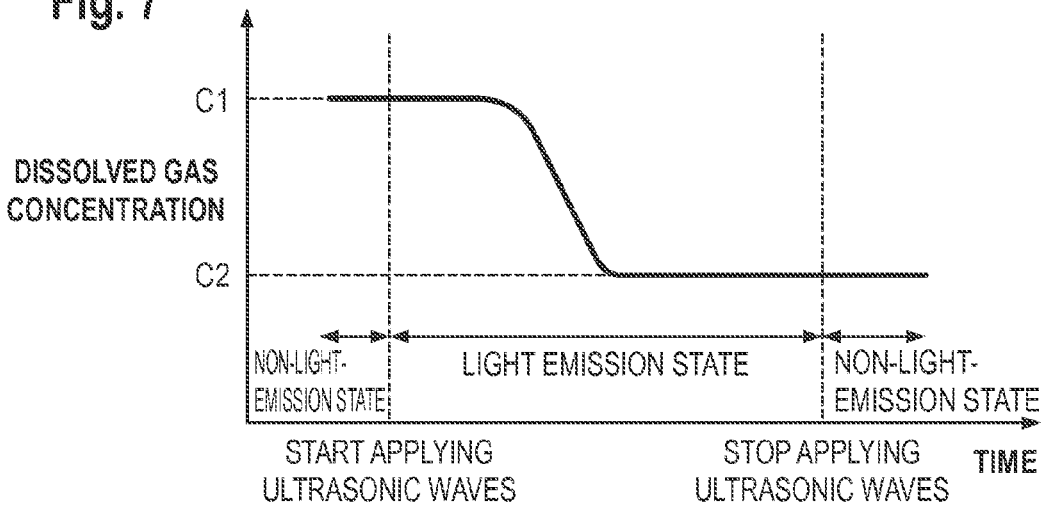
FIG. 7 is a diagram showing a relationship between the dissolved gas concentration and time, regarding the ultrasonic cleaning method according to one embodiment of the present invention.

In the liquid adjusting step (S30), with reference to FIG. 7 for example, the step of changing the dissolved gas concentration from a first dissolved gas concentration (C1) to a second dissolved gas concentration (C2) may further be performed. The dissolved gas concentration can be changed for example by adjusting the first supply valve 11 of ultrasonic cleaning apparatus 100 shown in FIG. 1 to thereby reduce the amount of supplied ultrapure water in which nitrogen gas is dissolved. The dissolved gas concentration can also be changed by adjusting the second supply valve 12 of ultrasonic cleaning apparatus 100 to thereby increase the amount of supplied ultrapure water in which nitrogen gas is not dissolved. Moreover, both the first supply valve 11 and the second supply valve 12 can be adjusted to adjust the dissolved gas concentration of the liquid. While the dissolved gas concentration in the liquid changes from the first dissolved gas concentration (C1) to the second dissolved gas concentration (C2), the liquid is continuously irradiated with ultrasonic waves. While the liquid is irradiated with ultrasonic waves, a state where sonoluminescence occurs may continue.

Here, how to determine the first dissolved gas concentration (C1) and the second dissolved gas concentration (C2) will be described. For example, cleaning liquids having respective dissolved gas concentrations different from each other are prepared, and wafer W to be cleaned is immersed in the cleaning liquids. After this, under the same conditions except for the dissolved gas concentration of the cleaning liquid, the cleaning liquids are irradiated with ultrasonic waves to clean wafer W. The dissolved gas concentration of the cleaning liquid providing a highest cleaning efficiency is defined as an optimum dissolved gas concentration and it is determined that this concentration is the second dissolved gas concentration. Since wafer W is cleaned finally in the liquid having the second dissolved gas concentration, the second dissolved gas concentration is preferably a concentration close to an optimum dissolved gas concentration. The second dissolved gas concentration, however, may not be an optimum dissolved gas concentration as long as the second dissolved gas concentration causes sonoluminescence to occur. The first dissolved gas concentration is defined as a concentration higher than the second dissolved gas concentration.

Figure 8:
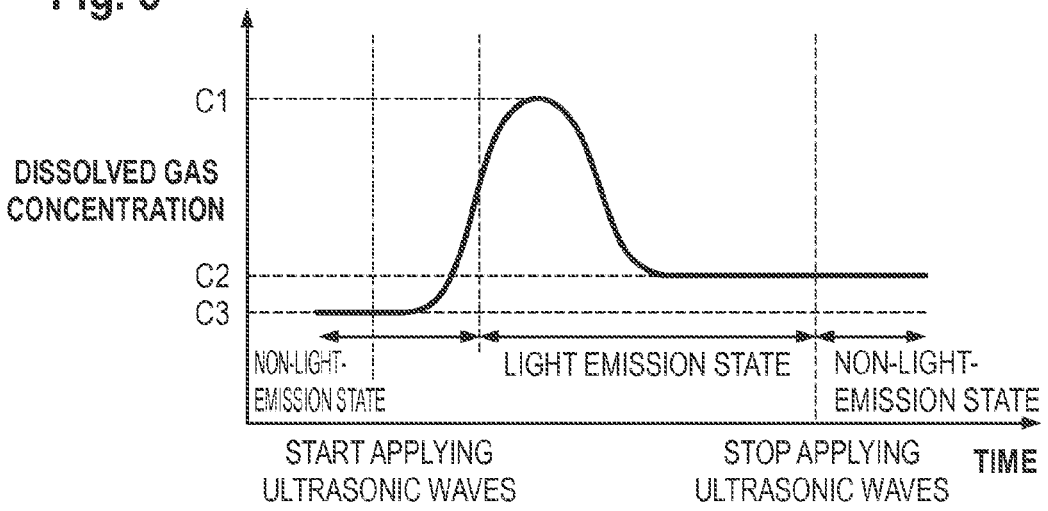
FIG. 8 is a diagram showing a relationship between the dissolved gas concentration and time, regarding the ultrasonic cleaning method according to one embodiment of the present invention.

In the liquid adjusting step (S30), with reference to FIG. 8 for example, the step of changing the dissolved gas concentration from a third dissolved gas concentration (C3) to the first dissolved gas concentration (C1) may further be performed. The third dissolved gas concentration is a concentration lower than the above-described first dissolved gas concentration. The third dissolved gas concentration may be substantially equal to the above-described second dissolved gas concentration. The third dissolved gas concentration may be higher or lower than the second dissolved gas concentration. The dissolved gas concentration is changed for example by supplying a liquid having a high dissolved gas concentration to cleaning tank 20 in which wafer W is contained. While the dissolved gas concentration of the liquid changes from the third dissolved gas concentration (C3) to the first dissolved gas concentration (C1), ultrasonic waves are continuously applied to the liquid. At the time when the dissolved gas concentration of the liquid is the third dissolved gas concentration (C3), sonoluminescence has not occurred and this is non-light-emission state. While the third dissolved gas concentration (C3) changes to the first dissolved gas concentration (C1), sonoluminescence occurs and a light emission state is reached.

Then, the step of changing the dissolved gas concentration from the first dissolved gas concentration (C1) to the second dissolved gas concentration (C2) is performed. While the dissolved gas concentration in the liquid is changing from the first dissolved gas concentration (C1) to the second dissolved gas concentration (C2), the liquid is continuously irradiated with ultrasonic waves. While the liquid is irradiated with ultrasonic waves, the state where sonoluminescence occurs may continue.

In the liquid adjusting step (S30), the liquid vibration strength measuring step (S20) may be continued. Specifically, while the dissolved gas concentration of the liquid is being changed, the liquid vibration strength at the frequency of ultrasonic waves and the liquid vibration strength at the fourth-order frequency of ultrasonic waves may be measured.

Preferably, in the liquid adjusting step (S30), based on the liquid vibration strength at the fourth-order frequency measured in the liquid vibration strength measuring step (S20), liquid adjusting mechanism 45 adjusts the liquid so that a state occurs where bubbles containing nitrogen are likely to be generated continuously in the liquid. Specifically, liquid adjusting mechanism 45 adjusts the dissolved gas concentration of the liquid so that the ratio determined by dividing the liquid vibration strength at the fourth-order frequency of ultrasonic waves by the liquid vibration strength at the fundamental frequency of ultrasonic waves is larger than 0.8/1000.

In the present embodiment, after the liquid adjusting step (S30) is performed, foggy bubbles are generated in the liquid. The foggy bubbles are bubbles containing the gas (nitrogen in the present embodiment) dissolved in the liquid. Thus, the state where the bubbles containing nitrogen continue to be generated is realized.

In the liquid preparing step (S10), a liquid in which bubbles containing nitrogen continue to be generated may be prepared directly. In this case, the liquid adjusting step (S30) can be skipped.

In the ultrasonic cleaning method according to the present embodiment, sonoluminescence occurs after the liquid adjusting step (S30). Sonoluminescence can be sensed by an image intensifier or photomultiplier as shown in FIG. 2. In the liquid adjusting step (S30), it is enough to enable the state where bubbles containing nitrogen continue to be generated in the liquid to be realized, and sonoluminescence may not occur in the liquid.

Next, a cleaning step (S40) is performed. In the cleaning step, wafer W, which is the object to be cleaned, is cleaned in the state where the bubbles containing nitrogen continue to be generated. In the cleaning step, the object to be cleaned is cleaned while the liquid is irradiated with ultrasonic waves so that the ratio determined by dividing the liquid vibration strength at the fourth-order frequency of the ultrasonic waves by the liquid vibration strength at the fundamental frequency of the ultrasonic waves is larger than 0.8/1000. As shown in FIG. 4, in the step of cleaning the object to be cleaned, preferably the liquid is irradiated with ultrasonic waves so that the liquid vibration strength at the fifth-order frequency of ultrasonic waves is larger than the liquid vibration strength at the fourth-order frequency. It is preferable that sonoluminescence is occurring in the cleaning step.

A description will now be given of a hypothesis about a mechanism by which a high particle removal rate is obtained in a stable manner when an object to be cleaned is cleaned while the liquid is irradiated with ultrasonic waves so that the ratio determined by dividing the vibration strength of the liquid at the fourth-order frequency of the ultrasonic waves by the vibration strength of the liquid at the fundamental frequency of the ultrasonic waves is larger than 0.8/1000.

The mechanism by which particles are removed by ultrasonic waves in the liquid is considered as being related to the cavitation phenomenon. The cavitation phenomenon is considered as a phenomenon in which bubbles continue to be generated by pressure variations (density variations) in a minute area of the liquid. Particles are considered as being efficiently removed when the cavitation phenomenon efficiently occurs in the liquid.

It is also considered that, in the case where the cavitation phenomenon efficiently occurs, fourth or higher harmonics are generated relatively large in amount when bubbles contract. Namely, it is considered that the state where the particle removal rate is high in a stable manner can be realized by adjusting the liquid so that fourth or higher harmonics are generated, for example.

Next, the functions and effects of the present embodiment will be described.

According to the ultrasonic cleaning method of the present embodiment, an object to be cleaned is cleaned while the liquid is irradiated with ultrasonic waves so that the ratio determined by dividing the liquid vibration strength at the fourth-order frequency of the ultrasonic waves by the liquid vibration strength at the fundamental frequency of the ultrasonic waves is larger than 0.8/1000. In this way, a high particle removal rate can be obtained in a stable manner.

According to the ultrasonic cleaning method of the present embodiment, in the step of cleaning the object to be cleaned, the liquid is irradiated with ultrasonic waves so that the liquid vibration strength at the fifth-order frequency of the ultrasonic waves is preferably larger than the liquid vibration strength at the fourth-order frequency. In this way, a high particle removal rate can be obtained in a more stable manner.

Furthermore, the ultrasonic cleaning method of the present embodiment further includes the step of measuring the liquid vibration strength at the fourth-order frequency and the liquid vibration strength at the fundamental frequency, and the step of calculating the ratio between the liquid vibration strength at the fourth-order frequency and the liquid vibration strength at the fundamental frequency. The ratio between the liquid vibration strength at the fourth-order frequency and the liquid vibration strength at the fundamental frequency can be calculated to confirm the state of the liquid.

Furthermore, according to the ultrasonic cleaning method of the present embodiment, in the step of cleaning the object to be cleaned, the liquid is adjusted based on the liquid vibration strength at the fourth-order frequency, so that the state in which bubbles containing the gas continue to be generated in the liquid is realized. In this way, the liquid having a high particle removal rate in a stable manner can efficiently be adjusted.

Furthermore, according to the ultrasonic cleaning method of the present embodiment, the step of cleaning the object to be cleaned includes the step in which sonoluminescence occurs. Thus, a high particle removal rate is obtained in a more stable manner.

Ultrasonic cleaning apparatus 100 according to the present embodiment has device 71 capable of measuring the vibration strength of the liquid at the fourth-order frequency of the ultrasonic waves. The state of the liquid can thus be confirmed.

Ultrasonic cleaning apparatus 100 of the present embodiment also has liquid adjusting mechanism 45 capable of realizing a state where bubbles containing gas continue to be generated in the liquid, based on the vibration strength of the liquid at the fourth-order frequency. Thus, the liquid having a high particle removal rate in a stable manner can efficiently be adjusted.

EXAMPLE 1

An object of the experiment here is to examine the relationship between the ratio between the vibration strength of the cleaning liquid at the fourth-order frequency and the vibration strength of the cleaning liquid at the fundamental frequency, and the particle removal rate.

First, five different cleaning liquids having respective dissolved nitrogen concentrations of 1.6 ppm, 5.2 ppm, 6.7 ppm, 7.8 ppm, and 15.7 ppm were prepared. To each of the five different cleaning liquids, ultrasonic waves were applied while nitrogen gas was introduced into the cleaning liquid by means of a bubble introducing tube. The introduced nitrogen gas had a volume of approximately 10 mL. After the nitrogen gas was introduced into the cleaning liquid, whether or not foggy bubbles were generated in the cleaning liquid was observed. Before and after the nitrogen gas was introduced into the cleaning liquid, the ratio between the vibration strength of the cleaning liquid at the fourth-order frequency of ultrasonic waves and the vibration strength of the cleaning liquid at the fundamental frequency of ultrasonic waves was measured while applying ultrasonic waves to the cleaning liquid.

A cleaning apparatus used in this experiment will be described with reference to FIG. 1. The square water tank made of quartz glass having a thickness of 3.0 mm was used as cleaning tank 20 in the experiment. The water tank had a width of 270 mm, a depth of 69 mm and a height of 285 mm in terms of inside dimension. The plate material forming the bottom wall had a thickness of 4.0 mm. Cleaning tank 20 had a capacity of 5 liters.

The amount of the cleaning liquid (mixed ultrapure water) supplied from supply 10 to cleaning tank 20 was set to 5 liters/min. The frequency of the ultrasonic waves applied from irradiation device 30 was set to 750 kHz and the output thereof was set to 1200 W (watt density of 5.6 W/cm2). The radiation surface of the vibrating plate in irradiation device 30 had a size of 80 mm—270 mm. The ultrasonic waves emitted from irradiation device 30 were provided onto the entire bottom surface of cleaning tank 20.

First supply valve 11 adjusting the amount of supply of the ultrapure water in which the nitrogen gas was dissolved and second supply valve 12 adjusting the amount of supply of the degassed water were controlled, and thereby the ultrapure water in which nitrogen was dissolved was supplied to cleaning tank 20 at 5 liters/min. The ultrapure water in the water tank was sampled and the dissolved nitrogen concentration was measured by monitoring device 40.

Next, an object to be cleaned that is used to measure the particle removal rate will be described.

A P-type silicon wafer having a diameter of 200 mm was used as the object to be cleaned. Silicon dioxide particles were attached to a mirror surface of the P-type silicon wafer by spin coating. The amount of attached particles was 2000 to 3000 particles in the case of the particles of 110 nm or more.

Next, a method for measuring the particle removal rate will be described.

The wafer having the silicon dioxide particles attached thereto was immersed in the water tank and cleaned for 10 minutes. Thereafter, the wafer was dried for 2 minutes by a spin dryer. The particle removal rate is obtained as a value acquired by dividing the number of particles that decrease after cleaning by the number of particles attached to the wafer before cleaning, and this value is expressed in percentage. LS6500 manufactured by Hitachi High-Technologies Corporation was used to measure the amount of attached particles.

The results of the present experiment will be described with reference to Table 1. The state where foggy bubbles are generated in the cleaning liquid is herein referred to as Mode-A, and the state where foggy bubbles are not generated in the cleaning liquid is herein referred to as Mode-B. Mode-A is also a state of a high particle removal rate of approximately 30.5%, and Mode-B is also a state of a low particle removal rate of approximately 18.8%.

When the dissolved nitrogen concentration was 1.6 ppm or less, no foggy bubbles were observed in the cleaning liquid (Mode-B). When the dissolved nitrogen concentration was not less than 5.2 ppm and not more than 7.8 ppm, foggy bubbles were not generated in the cleaning liquid before the nitrogen gas was introduced by means of the bubble introducing tube into the cleaning liquid (Mode-B). However, after the nitrogen gas was introduced by means of the bubble introducing tube into the cleaning liquid, foggy bubbles were generated in the cleaning liquid (Mode-A). Moreover, when the dissolved nitrogen concentration was 15.7 ppm, foggy bubbles were generated in the cleaning liquid before and after nitrogen gas was introduced by means of the bubble introducing tube into the cleaning liquid (Mode-A).

Figure 3:
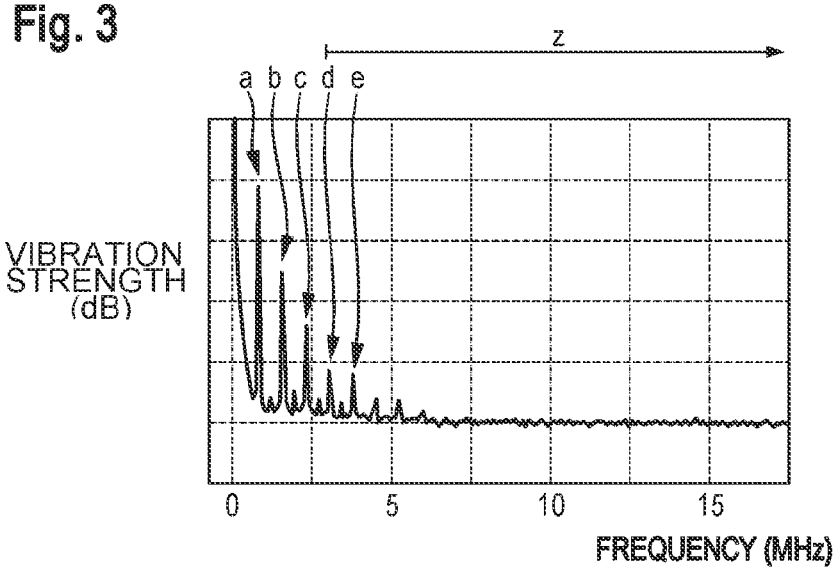
FIG. 3 shows a vibration strength spectrum when the vibration strength of a liquid is measured using an ultrasonic cleaning apparatus according to a comparative example.

FIG. 4 shows frequency characteristics of the vibration strength of the cleaning liquid in Mode-A where the dissolved nitrogen concentration is 5.2 ppm. In contrast, FIG. 3 shows frequency characteristics of the vibration strength of the cleaning liquid in Mode-B where the dissolved nitrogen concentration is 5.2 ppm. The vibration strength of the cleaning liquid at frequency a (fundamental frequency) in FIG. 4 and that in FIG. 3 are substantially equal to each other. The vibration strength of the cleaning liquid at frequency d (fourth-order frequency) in Mode-A, however, is higher than that in Mode-B. In Mode-A, the ratio between the vibration strength of the cleaning liquid at the fourth-order frequency and the vibration strength of the cleaning liquid at the fundamental frequency was approximately 5/1000. In Mode-B, the ratio between the vibration strength of the cleaning liquid at the fourth-order frequency and the vibration strength of the cleaning liquid at the fundamental frequency was approximately 0.8/1000.

TABLE 1

| | dissolved nitrogen concentration [ppm] | | | | |
|---|---|---|---|---|---|
| | 1.6 | 5.2 | 6.7 | 7.8 | 15.7 |
| Mode-A | — | 5/1000 | 3/1000 | 10/1000 | 50/1000 |
| Mode-B | 0.5/1000 | 0.8/1000 | 0.8/1000 | — | — |

As shown in Table 1, in Mode-A, the ratio between the vibration strength of the cleaning liquid at the fourth-order frequency and the vibration strength of the cleaning liquid at the fundamental frequency was larger than 0.8/1000. In Mode-B, the ratio between the vibration strength of the cleaning liquid at the fourth-order frequency and the vibration strength of the cleaning liquid at the fundamental frequency was 0.8/1000 or less. From the results above, it is considered that the state of Mode-A can be realized by having the ratio higher than 0.8/1000 between the vibration strength of the cleaning liquid at the fourth-order frequency and the vibration strength of the cleaning liquid at the fundamental frequency.

EXAMPLE 2

An object of the experiment here is to examine a range of the dissolved nitrogen concentration for generating the foggy bubbles in the cleaning liquid.

First, seven different cleaning liquids having respective dissolved nitrogen concentrations of 1.9 ppm, 4.9 ppm, 6.0 ppm, 7.8 ppm, 9.6 ppm, 11.0 ppm, and 15.7 ppm were prepared. To these seven different cleaning liquids each, ultrasonic waves were applied while a stirring unit was rotated to stir the cleaning liquid. The number of revolutions of the stirring unit was set to 1400 rpm. The frequency of the applied ultrasonic waves was set to 750 kHz and the output thereof was set to 1200 W. Whether or not foggy bubbles were generated in the cleaning liquid after the cleaning liquid was stirred was observed.

Figure 5:
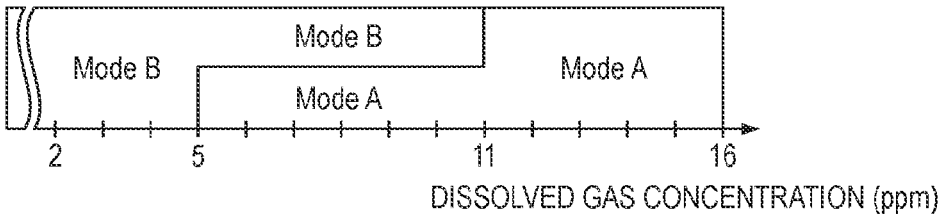
FIG. 5 is a schematic diagram showing a relationship between the dissolved nitrogen concentration and the presence or absence of foggy bubbles.

The results of the present experiment will be described with reference to FIG. 5. The state where foggy bubbles are generated in the cleaning liquid is herein referred to as Mode-A, and the state where foggy bubbles are not generated in the cleaning liquid is herein referred to as Mode-B. Mode-A is also a state of a high particle removal rate of approximately 30.0%, and Mode-B is also a state of a low particle removal rate of approximately 18.8%. In Mode-A, particularly in the case where the particle removal rate is high, sonoluminescence occurs. In Mode-B, sonoluminescence fails to occur. In Mode-A, the ratio between the vibration strength of the cleaning liquid at the fourth-order frequency and the vibration strength of the cleaning liquid at the fundamental frequency was approximately 5/1000. In Mode-B, the ratio between the vibration strength of the cleaning liquid at the fourth-order frequency and the vibration strength of the cleaning liquid at the fundamental frequency was approximately 0.8/1000.

When the dissolved nitrogen concentration was 4.9 ppm or less, foggy bubbles were not observed in the cleaning liquid (Mode-B). When the dissolved nitrogen concentration was not less than 6.0 ppm and not more than 9.6 ppm, foggy bubbles were not generated in the cleaning liquid before the cleaning liquid was stirred by the stirring unit (Mode-B). However, after the cleaning liquid was stirred by the stirring unit, foggy bubbles were generated in the cleaning liquid (Mode-A). When the dissolved nitrogen concentration was not less than 11.0 ppm and not more than 15.7 ppm, foggy bubbles were generated in the cleaning liquid before and after the cleaning liquid was stirred by the stirring unit (Mode-A). From the experiment above, it is considered that the state of the cleaning liquid can be changed from Mode-B to Mode-A by stirring the cleaning liquid in the case where the dissolved nitrogen concentration of the cleaning liquid is not less than 5 ppm and not more than 11 ppm. It is also considered that Mode-A can be realized under the condition that the dissolved nitrogen concentration of the cleaning liquid is 5 ppm or more.

It should be understood that the embodiment and the examples disclosed herein are illustrative and not limitative in any respect. The scope of the present invention is defined by the terms of the claims, rather than the embodiment and the examples above.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

DESCRIPTION OF THE REFERENCE CHARACTERS

5 hydrophone probe
10 supply
11 first supply valve
12 second supply valve
20 cleaning tank
21 indirect water tank
22 holding portion
23 liquid introducing pipe
30 irradiation device
40 monitoring device
41 extraction pipe
42 pump
43 dissolved nitrogen concentration meter
45 liquid adjusting mechanism
50 dark room
60 light emission detecting apparatus
61 image processing apparatus
70 measuring instrument
71 device for measuring the vibration strength
100 ultrasonic cleaning apparatus
W wafer

What is claimed is:

1. An ultrasonic cleaning method for cleaning an object in a liquid in which a gas is dissolved, the method comprising:

irradiating the liquid in which the gas is dissolved with ultrasonic waves using an irradiation unit;

measuring a first strength of acoustic waves of the liquid, at a fourth-order frequency of ultrasonic waves, and a second strength of the acoustic waves of the liquid, at a fundamental frequency of ultrasonic waves, as a second strength;

calculating a ratio between the first strength and the second strength, by dividing the first strength by the second strength;

adjusting the liquid by changing a dissolved gas concentration, optionally while stirring the liquid, so that the ratio determined in the calculating is larger than 0.8/1000; and cleaning the object while applying ultrasonic waves to the liquid so that the ratio is larger than 0.8/1000.

2. The ultrasonic cleaning method recited in claim 1, wherein the step of cleaning the object includes applying the ultrasonic waves to the liquid so that a third strength of acoustic waves of the liquid, at a fifth-order frequency of the ultrasonic waves is larger, than the first strength.

3. The ultrasonic cleaning method recited in claim 1, wherein in the step of cleaning the object, the liquid is adjusted, based on the first strength, so that a state where bubbles containing the gas continue to be generated in the liquid is realized.

4. The ultrasonic cleaning method recited in claim 1, wherein sonoluminescence occurs during the cleaning of the object.

5. The ultrasonic cleaning method recited in claim 1, wherein the gas is nitrogen and the dissolved gas concentration of the liquid is 5 ppm or more.

6. The ultrasonic cleaning method recited in claim 1, further comprising:

preparing the liquid in which the gas is dissolved.

7. The ultrasonic cleaning method recited in claim 1, further comprising, during the adjusting:

stirring the liquid.

8. The ultrasonic cleaning method recited in claim 1, wherein the ratio is larger than 3/1000.

9. The ultrasonic cleaning method recited in claim 1, wherein the ratio is larger than 5/1000.

10. The ultrasonic cleaning method recited in claim 1, wherein the ratio is larger than 10/1000.

11. The ultrasonic cleaning method recited in claim 1, wherein the ratio is larger than 50/1000.

12. The ultrasonic cleaning method recited in claim 1, wherein the ratio is in a range of from larger than 0.8/1000 to 50/1000.

13. The ultrasonic cleaning method recited in claim 1, wherein the gas is nitrogen.

14. The ultrasonic cleaning method recited in claim 1, wherein the dissolved gas concentration of the liquid is 5 ppm or more.

15. The ultrasonic cleaning method recited in claim 1, wherein the dissolved gas concentration of the liquid is in a range of from 5 ppm to 15.7 ppm.

16. The ultrasonic cleaning method recited in claim 1, wherein the gas is nitrogen and the dissolved gas concentration of the liquid is in a range of from 5 ppm to 15.7 ppm.

* * * * *